US006148836A

United States Patent [19]

Cananzey

[11] Patent Number: 6,148,836

[45] Date of Patent: Nov. 21, 2000

[54] HUNTER'S PORTABLE INSTANT BLIND

[76] Inventor: Gary M. Cananzey, 426 Main St., Wareham, Mass. 02571

[21] Appl. No.: 09/169,830

[22] Filed: Oct. 11, 1998

[51] Int. Cl.[7] ..... E04H 15/00

[52] U.S. Cl. ..... 135/901; 135/90; 43/1

[58] Field of Search ..... 135/90, 96, 900–902; 43/1

[56] References Cited

U.S. PATENT DOCUMENTS

| | | | |
|---|---|---|---|
| 4,284,095 | 8/1981 | Norton | 135/21 |
| 4,505,286 | 3/1985 | Madion | 135/90 |
| 4,739,785 | 4/1988 | Poulson | 135/117 |
| 4,825,578 | 5/1989 | Robinson | 135/90 |
| 5,414,950 | 5/1995 | Johnson | 135/90 |
| 5,630,439 | 5/1997 | Hutto | 135/90 |
| 5,669,403 | 9/1997 | Belcher | 135/90 |
| 5,787,914 | 8/1998 | Greywall | 135/90 |
| 5,803,694 | 9/1998 | Steele | 135/901 |

*Primary Examiner*—Beth A. Stephan
*Attorney, Agent, or Firm*—James F. Baird, Esq.

[57] ABSTRACT

A portable, light weight blind, for use by a hunter, photographer or an individual observing wildlife, that is suspended on a horizontal rod when in a fully set up configuration. The rod is shaped in order to form a screw at a first end and a crank handle at the second end. The blind has a plurality of flaps that may be in a fully opened position for sighting and shooting thru or a closed position to conceal the hunter from the animals view, or any position between fully opened or fully closed. The blind may be wrapped around the rod for storage, transportation and when not in use.

2 Claims, 9 Drawing Sheets

HUNTER'S PORTABLE INSTANT BLIND

BACKGROUND

The field of my invention is blinds for use by primarily by Hunter's. The invention portrayed is a new concealment device practical for both hunting and wildlife observation. Hunters have developed many means of concealing themselves from animals amongst the most obvious are camouflaged clothing and permanent and semi-permanent structures including tree stands. All of the means presently available; other than camouflaged clothing suffer from the problem that the hunter must set the structure up as a permanent structure. This requires the hunter to plan ahead, select the desired location, erect the structure prior to hunting then return to the site when ready to hunt. Even a semi-permanent structure such as a tree stand suffers from the problem that in the event the hunter desires to move the structure he will make considerable noise during the move thereby eliminating the element of surprise that is necessary or the hunter's goal will not be accomplished.

The present invention provides an improved portable, lightweight, easily, quickly and quietly set up hunter's blind.

An object of the invention is to provide an improved hunter's blind that is both portable and lightweight.

A further object of the invention is to provide a hunter's blind that may be readily and quietly modified to permit the hunter to change his position from standing to sitting or some other position.

An additional object of the invention is to provide a hunter's blind that may be quickly, quietly and easily setup in a desired position.

A still further object of the invention is to provide a hunter's blind that may be quickly, quietly and easily taken down from a first site and quickly, quietly and easily setup at a second site.

With these and other objects in view, as will be apparent to those skilled in the art, the invention resides in the combination of parts set forth in the specification and covered by the claims appended hereto.

SUMMARY OF THE INVENTION

The invention portrayed is a new concealment device for hunting and wildlife observation. There is a need for this device as more people have interest in hunting from the ground or cannot climb a tree to safely enter a tree stand. This device unlike other ground blinds is extremely portable and may be fully deployed by the user within a few seconds. It is comprised of two basic parts, the Shaft and the Blind.

The Shaft is a piece of material that attaches to a tree and supports the Blind.

The Blind may be made of nearly any type of lightweight material (cloth, plastic or other type). The blind material is made with a camoflage design thereon. There may be several different camoflage designs, one for each of the various seasons of the year, or one for variations in terrain or environment. The Blind attaches to the Shaft by way of a closure method (Velcro, buttons, snaps, etc.). The blind is made in such a way to be easily removed from the Shaft so that different camouflage patterns may be employed to accommodate the different backgrounds found in nature during different seasons.

The Shaft is a rodlike device made from steel or any rigid material. It has a first end which is made to attach to a tree. The first end of the Shaft can be a screw or a strap device. Where the first end of the Shaft is a screw a plate is fixedly added at the termination of the screw that acts as a stop when the shaft is screwed into a tree. The plate acts to stabilize the Shaft as the device is screwed in tightly to the tree and the tree creates pressure against the plate. The result is that the Shaft becomes ridged in a perpendicular against the tree and at the same time parallel to the ground below. The Shaft continues past the plate and is of sufficient diameter to act as a side register for the Blind material.

The Shaft continues as a straight rod a distance, which corresponds to the width of the Blind. Past the Blind, at the second end of the Shaft, the Shaft is formed and shaped into a device used for generating the leverage necessary to screw the Shaft into the tree. This device can be a crank as shown or can be a means such as a knob or other device that is attached to the second end of the Shaft, which allows the user to apply the leverage, needed to turn the shaft first end screw into the tree.

The Blind attaches to the Shaft by a closure method. The closure method allows a secure attachment to the Shaft but is intended to be a fit loose enough to allow the shaft to turn freely when the Blind is attached. The Blind has two surfaces both of which can be of a camouflage material. The Blind has a window created by a flap or flaps thru which the hunter may observe and shoot. The window may have a flap or several flaps which allow the user to close all or part of the window for better concealment or to be used for a sitting or standing position. The flaps have a method of closure (hook and loop fasterners, buttons, snaps, etc.) which allow them to be held securely in the open or closed position on both surfaces of the Blind which allows the user to hunt or observe from either side of the tree (right or left) and still be on the correct side of the Blind opposite and away from the animal being observed or hunted.

The Blind also has devices that act as additional stabilizing means for attaching the Blind to the ground or to other available objects. The means may be loops, strings or other devices or materials.

The Blind has straps which allow the Blind to be rolled up and held wrapped around the Shaft for carrying. The straps have a closure method and may be (hook and loop fasterners, buttons, snaps, etc.)

With the Blind wrapped securely around the Shaft the user places the first end against the tree and cranks the end clock wise and screws the assembly into the tree. When the plate is against the tree and the assembly is firmly attached to the tree and stabilized the user opens the straps and the Blind unrolls or unfurls to the ground, the user then may use the devices and to attach the Blind more securely to the ground or other available objects.

While the invention will be discussed in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF THE DRAWINGS

The object and features of the invention may be understood with reference to the following detailed description of an illustive embodiment of the invention, taken together with the accompanying drawings in which.

DESCRIPTION OF THE PREFERRED EMBODIMENT

Figure 1:
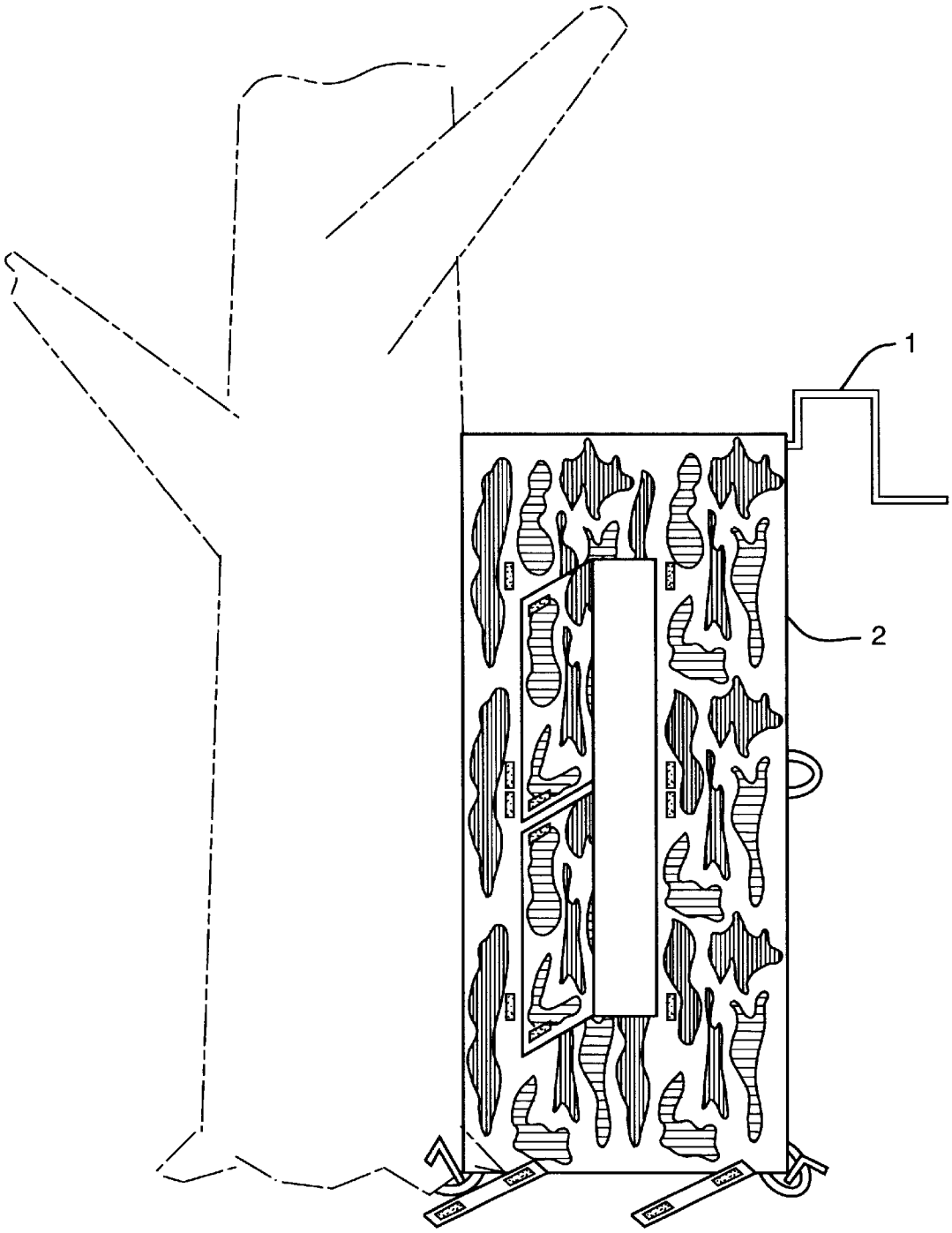
FIG. 1. Illustrates a perspective view of the Hunter's Portable Instant Blind in a fully setup configeration. The tree is for illustrative purposes only and is not a part of the invention.
Figure 2:
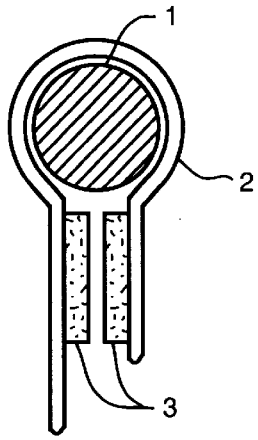
FIG. 2. Is a cutaway end view of the Shaft 1 indicating the Blind 2 with closure device 3 being hook and loop fasterners.
Figure 5:
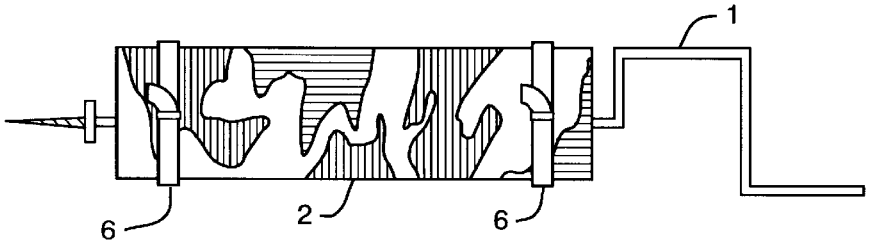
FIG. 5. Illustrates a Front view of the Hunter's Portable Instant Blind in a rolled up configeration. Straps 6 are indicated holding the Blind 2 in the rolled up position on the Shaft 1.
Figure 6:
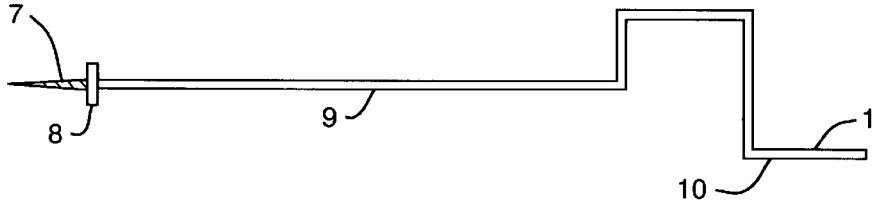
FIG. 6. Illustrates a Front side view of the Shaft 1 indicating the first end screw 7 the plate 8 the mid section 9 and the crank section 10.
Figure 3:
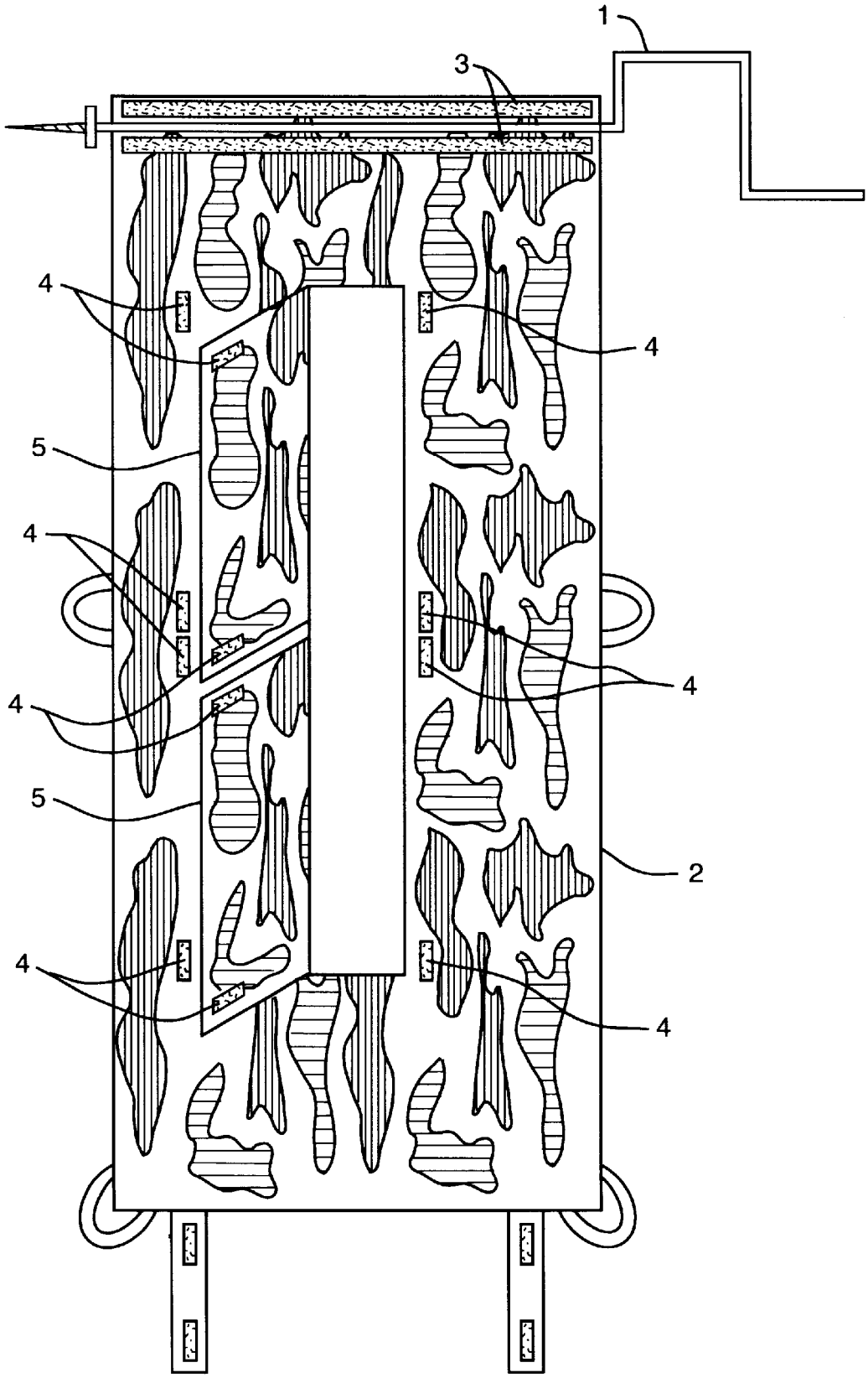
FIG. 3. Is a Front side view of the invention with the Blind 2 not wrapped around the Shaft 1, the closure device 3 not being engaged. Additional hook and loop fasterners 4 are shown that could be used to hold the Flaps 5 open or closed.
Figure 4:
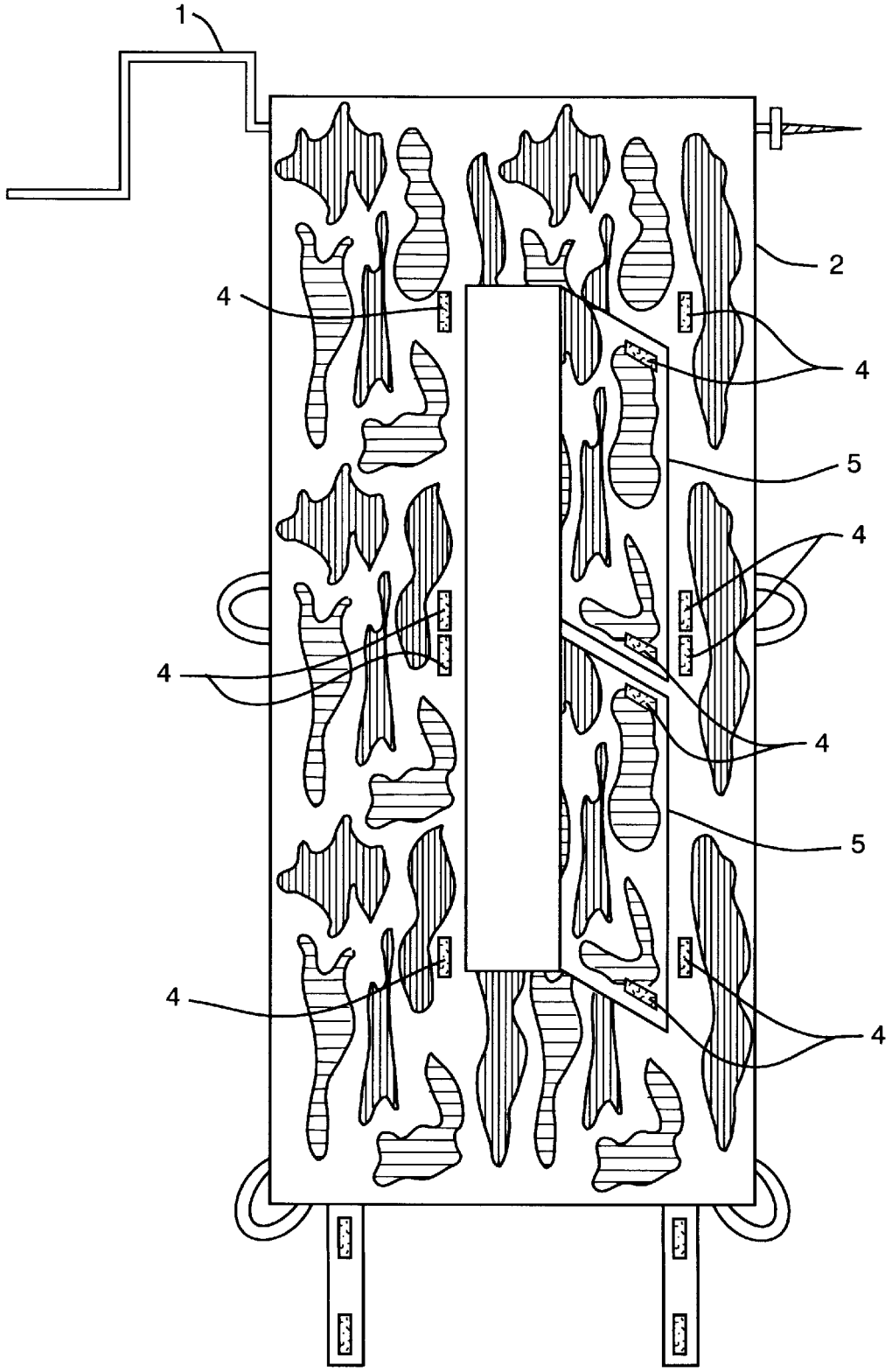
FIG. 4. Illustrates a Back side view of the invention indicating that the invention may be used from either side and is therefore functional for both left and right handed individuals.
Figure 7:
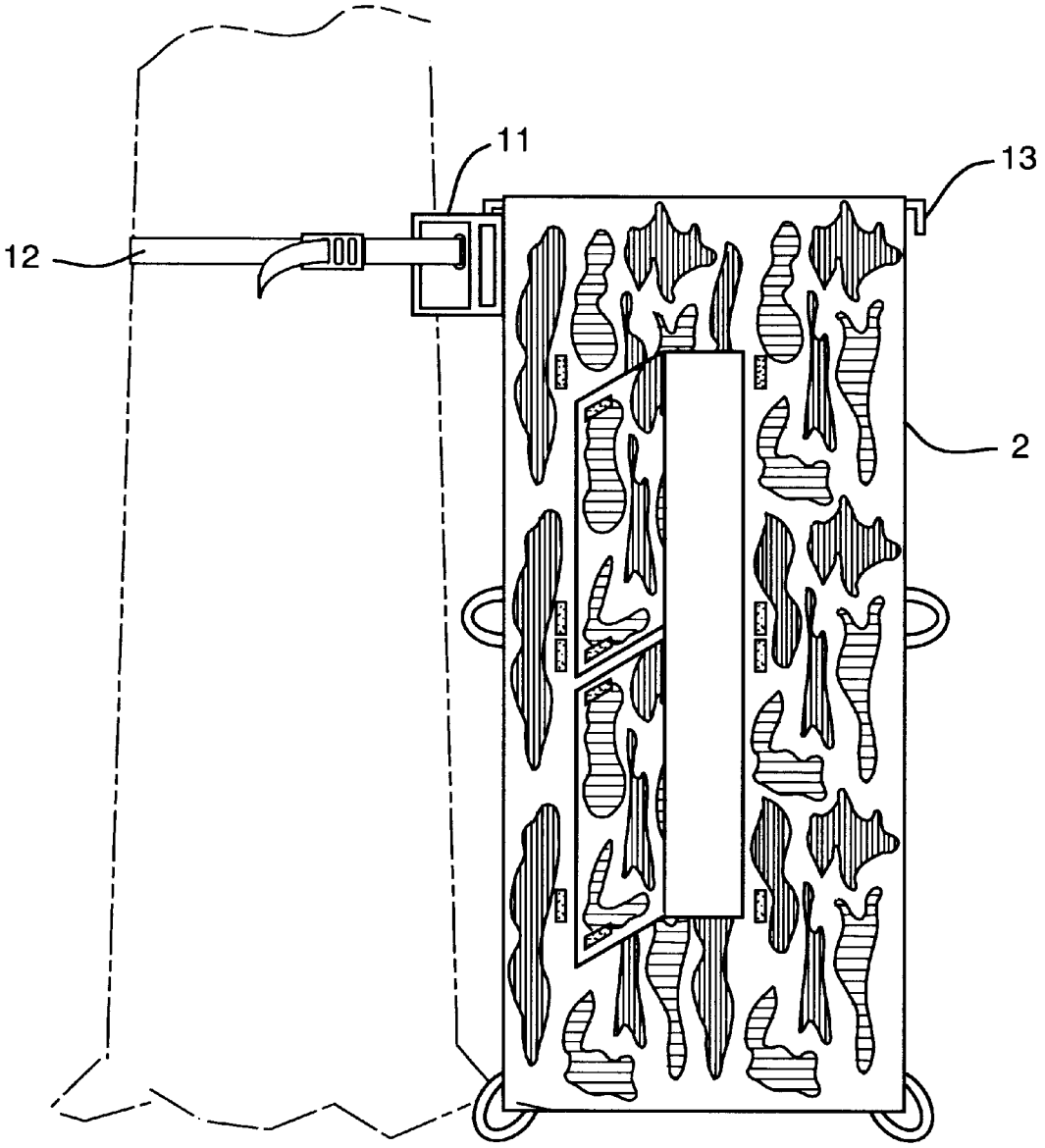
FIG. 7. Illustrates an alternative configeration where a mounting bracket 11 is used in conjunction with a belt 12 to secure the alternate Shaft 13 to a tree (tree shown for illustrative purposes only) a Front view of the Blind 2 is also shown.
Figure 8:
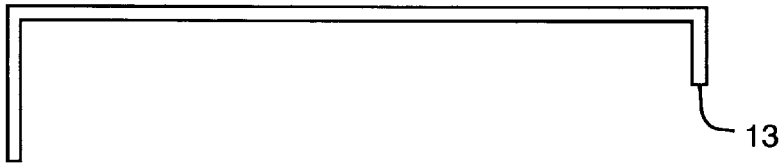
FIG. 8. Illustrates a side view of the alternate Shaft 13.
Figure 9:
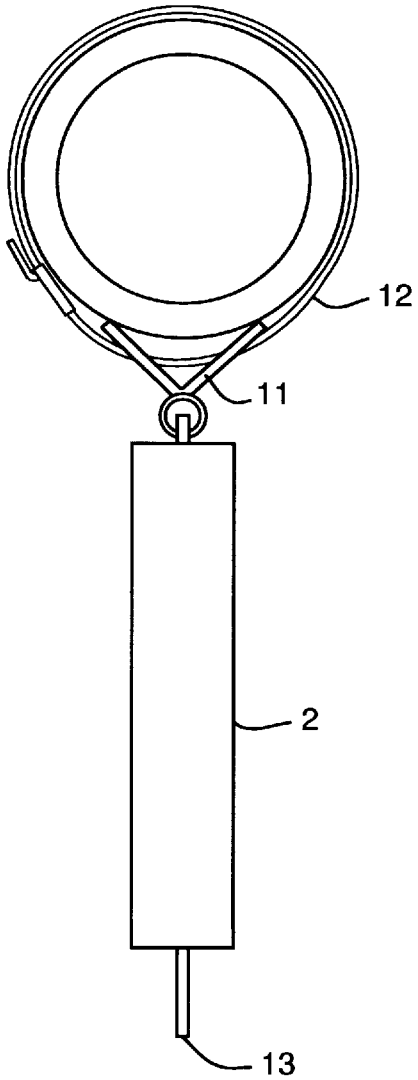
FIG. 9. Illustrates a top view of the alternative configeration showing the belt 12, alternative Shaft 13, mounting bracket 11 and Blind 2.
Figure 10:
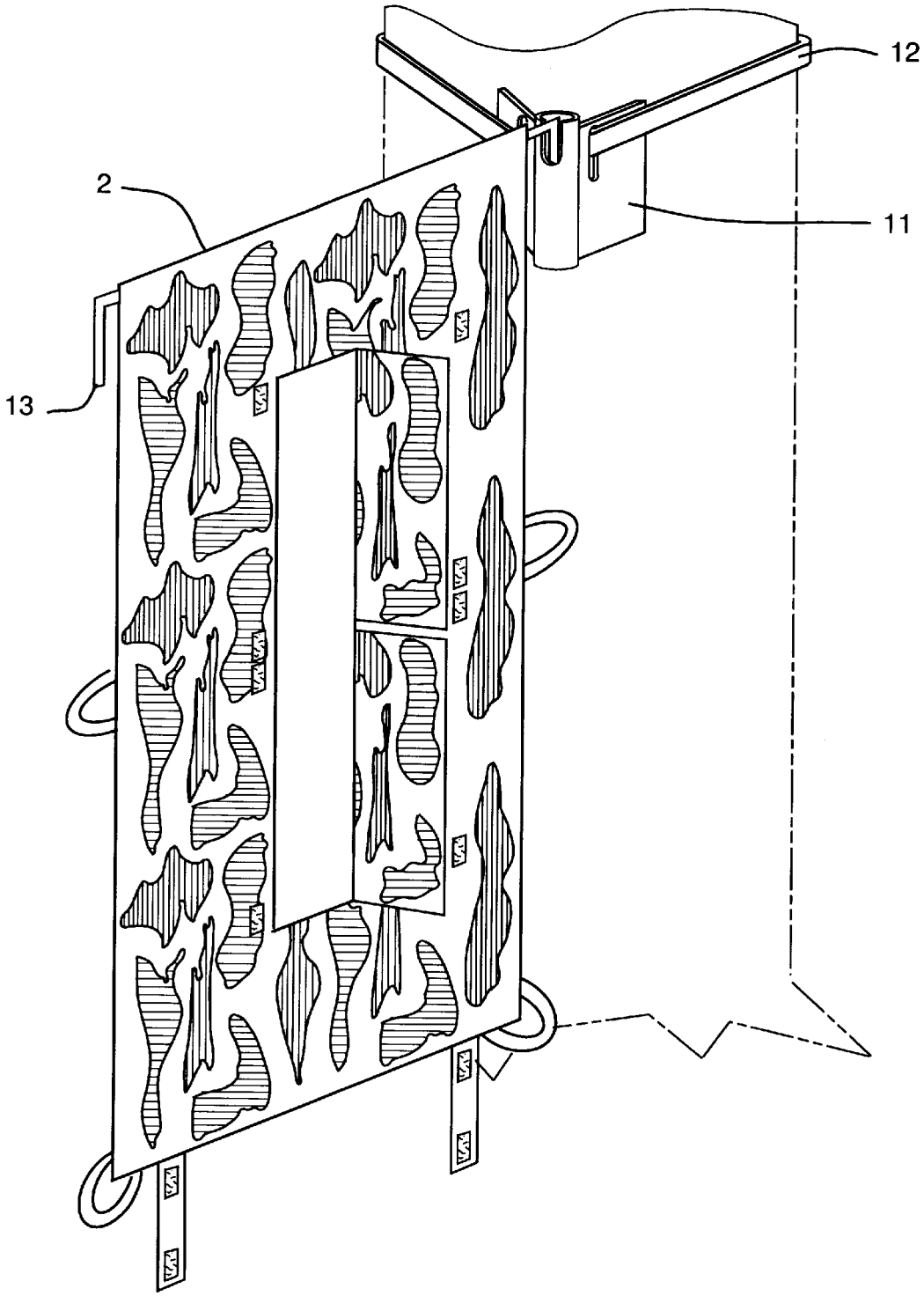
FIG. 10. Illustrates a Back perspective side view of the alternative configeration.
Figure 11:
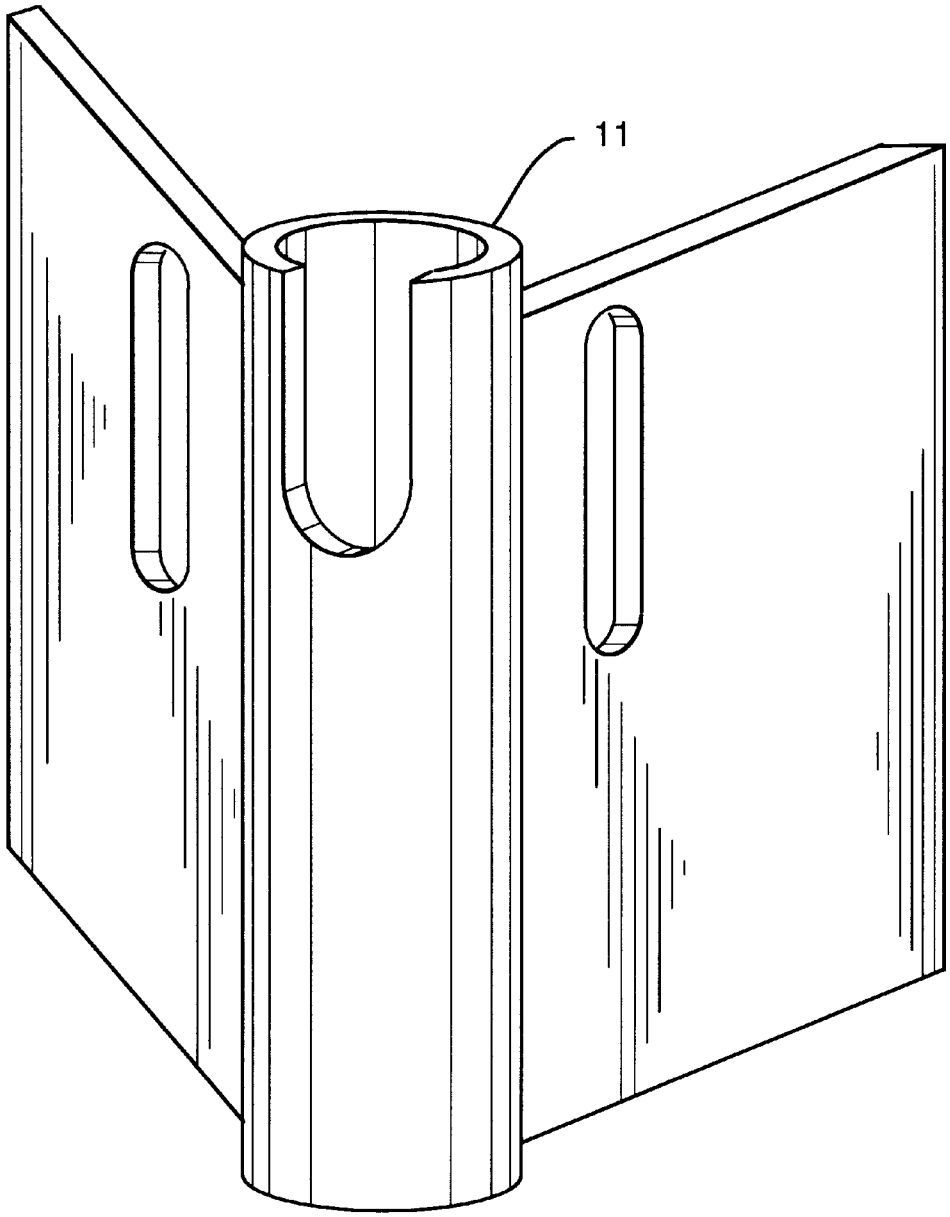
FIG. 11 Illustrates a perspective view of the mounting bracket 11.
Figure 12A:
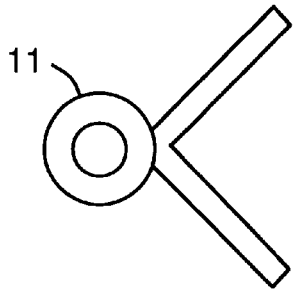
FIG. 12 Illustrates at 12A a top plan view of the mounting bracket 11, at 12B a side plan view of the mounting bracket 11 and at 12C a Front plan view of the mounting bracket.
Figure 12B:
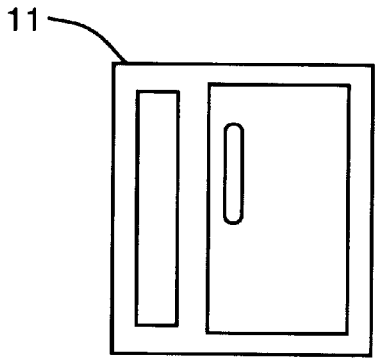
Figure 12C:
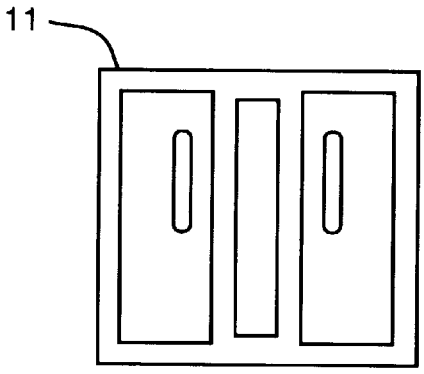

Turning first to FIG. 1 there is shown the present invention, The Hunter's Portable Instant Blind, in a fully set up configuration. FIG. 2 illustrates the Shaft 1 indicating the Blind 2 with the closure device 3 being hook and loop fasterners. FIG. 3 shows Flaps 5 and additional strips 4 that may be used to hold the Flaps 5 in an open or closed position. FIG. 3 and FIG. 4 shows how the camouflage design is imprinted on both the front and back sides of the Blind 2 in order that the invention may be used from either side. FIG. 5 shows the Blind 2 in a rolled up or stored configuration FIG. 6 shows the Shaft 1 indicating the first end screw 7, the plate 8, the mid section 9 and the crank section 10.

The invention portrayed is a new concealment device for hunting and wildlife observation. It is comprised of two basic parts, the Shaft I and the Blind 2. The Blind 2 attaches to the Shaft 1 by way of a closure method (Velcro, buttons, snaps, etc.). The Blind 2 is made in such a way to be easily removed from the Shaft 1 so that different camouflage patterns may be employed to accommodate the different backgrounds found in nature during different seasons.

The Shaft 1 is a rodlike device made from steel or any rigid material. It has a first end which is made to attach to a tree. The first end can be a screw or a strap device, in the preferred embodiment a screw 7 is used. In order to firmly secure the Shaft 1, the plate 8 is fixedly attached to the Shaft 1 and acts as a stop when the Shaft 1 is screwed into a tree. The device becomes rigid against the tree when the Shaft 1 is screwed in tightly to the tree and creates pressure against the plate 8.

The Shaft 1 has a mid section 9 that is of sufficient diameter to act as a side register for the Blind 2. The mid section 9 is of a width, which corresponds to the width of the Blind 2. At the end of the mid section 9 is attached a device used for generating the leverage necessary to screw the first end screw 7 of the Shaft 1 into the tree. This device can be a crank as shown (crank section 10) or can be a knob or other device, which allows the user to apply the leverage, needed to turn the Shaft 1.

The Blind 2 is a device which attaches to the Shaft 1 by a closure method. The closure method allows a secure attachment to the Shaft 1 but is intended to be a fit loose enough to allow the Shaft 1 to turn freely when the Blind 2 is attached. The Blind 2 has two surfaces both of which can be of a camouflage material. The Blind 2 has a window thru which the hunter may observe of shoot. The window is created by a flap or several flaps 5 which allow the user to close all or part of the window for better concealment or to be used for a sitting or standing position. The flaps 5 have a method of closure (hook and loop fasterners, buttons, snaps, etc.) which allow them to be held securely in the open or closed position. The method of closure exists on both surfaces of the Blind 2 which allows the user to hunt or observe from either side of the tree (right or left) and still be on the correct side of the Blind 2 opposite and away from game.

The Blind 2 also has devices that act as additional stabilizing methods for attaching the Blind 2 to the ground or to other available objects. Loops, strings or other devices or materials are incorporated to provide means to attach the Blind 2 to the ground or other objects in the area.

The Blind 2.has straps 6 which allow the Blind to be rolled up and held wrapped around the Shaft 1 for carrying. The straps 6 have a closure method and may be (hook and loop fasterners, buttons, snaps,etc.) The portable blind further comprises an alternative shaft 13, having a belt 12 and a bracket 11 for attaching the blind 2 to the tree.

With the Blind 2 wrapped securely around the Shaft 1 the user places the first end against the tree and cranks the second end clock wise and screws the assembly into the tree. When the plate 8 is against the tree and the assembly is firmly attached to the tree and stabilized the user opens the straps 6 and the Blind 2 unrolls or unfurls to the ground, the user then may use the devices to attach the Blind more securely to the ground or other available objects.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I claim the following:

1. New and improved portable Hunter's Blind comprising:

a.) A rigid elongated member with a first end, mid section and a second end, the first end being shaped as a screw with the apex being the beginning point of the first end and with sharp spiraling ribs, the mid section being a predetermined length and beginning at the termination of said first end and said spiraling ribs and continuing to a beginning of said second end said mid section being straight without any change in diameter or shape, the second end being formed to a Z shape creating a handle;

b.) a sheet of thin flexible lightweight material cut in the shape of a rectangle having a width dimension, a length dimension, a top edge, a bottom edge and two side edges, said width dimension corresponding to said rigid elongated member mid section predetermined length, said top edge and said bottom edge having said width dimension, said side edges having said length dimension, said sheet of thin flexible lightweight material having a first surface and a second surface, a random camouflage pattern being imprinted on both said first surface and said second surface, said sheet of thin flexible lightweight material having a plurality of cuts therein forming a plurality of flaps;

c.) two strips of hook and loop fasteners being spaced a predetermined distance and positioned near and parallel to said sheet of thin flexible lightweight material top edge first surface;

d.) a plurality of loops formed of said thin flexible lightweight material attached to said sheet of thin flexible lightweight material side edges and bottom edge;

e.) a plurality of strips formed of said thin flexible lightweight material attached to said sheet of thin flexible lightweight material bottom edge;

f.) a plurality of hook and loop fasteners patches positioned on both said sheet of thin flexible lightweight material first surface and second surface, and also on said strips; and g.) a plurality of stakes.

2. New and improved portable Hunter's Blind comprising:

a.) A rigid elongated member with a first end, mid section and a second end, the mid section being a predetermined length and beginning at the termination of said first end and continuing to a beginning of said second end, the first end extending perpendicularly from the mid section thereby forming a 90 degree angle said mid section being straight without any change in diameter or shape, the second end extending perpendicularly from the mid section thereby creating a second 9° angle;

b.) a sheet of thin flexible lightweight material cut in the shape of a rectangle having a width dimension, a length dimension, a top edge, a bottom edge and two side edges, said width dimension corresponding to said rigid elongated member mid section predetermined length, said top edge and said bottom edge having said width dimension, said side edges having said length dimension, said sheet of thin flexible lightweight material having a first surface and a second surface, a random camouflage pattern being imprinted on both said first surface and said second surface, said sheet of thin flexible lightweight material having a plurality of cuts therein forming a plurality of flaps;

c.) two strips of hook and loop fasteners being spaced a predetermined distance and positioned near and parallel to said sheet of thin flexible lightweight material top edge first surface;

d.) a plurality of loops formed of said thin flexible lightweight material attached to said sheet of thin flexible lightweight material side edges and bottom edge;

e.) a plurality of strips formed of said thin flexible lightweight material attached to said sheet of thin flexible lightweight material bottom edge;

f) a plurality of hook and loop fasteners patches positioned on both said sheet of thin flexible lightweight material first surface and second surface, and also on said strips;

g.) a plurality of stakes;

h.) an elongated belt; and i.) a bracket sized and shaped to receive said rigid elongated member first end and also sized and shaped to receive said elongated belt.

* * * * *